US010189028B2

(12) United States Patent
Convery

(10) Patent No.: US 10,189,028 B2
(45) Date of Patent: Jan. 29, 2019

(54) METHOD AND APPARATUS FOR WASHING AND GRADING AGGREGATE

(71) Applicant: CDE Global Limited, Cookstown, County Tyrone (GB)

(72) Inventor: Anthony Convery, Moneymore (GB)

(73) Assignee: CDE Global Limited, Cookstown, County Tyrone (GB)

( * ) Notice: Subject to any disclaimer, the term of this patent is extended or adjusted under 35 U.S.C. 154(b) by 0 days.

(21) Appl. No.: 15/884,891

(22) Filed: Jan. 31, 2018

(65) Prior Publication Data

US 2018/0214889 A1 Aug. 2, 2018

(30) Foreign Application Priority Data

Feb. 1, 2017 (GB) ..... 1701668.4

(51) Int. Cl.
*B03B 5/04* (2006.01)
*B03B 5/34* (2006.01)
*B03B 9/00* (2006.01)

(52) U.S. Cl.
CPC ..... *B03B 9/00* (2013.01); *B03B 5/04* (2013.01); *B03B 5/34* (2013.01)

(58) Field of Classification Search
CPC ..... B03B 5/04; B03B 5/34; B03B 9/00
USPC ..... 209/12.1, 13, 17, 18, 725, 728
See application file for complete search history.

(56) References Cited

U.S. PATENT DOCUMENTS 4,634,535 A * 1/1987 Lott ..... B01D 21/00 210/780
5,582,727 A * 12/1996 Foster ..... B01D 21/267 209/322
6,138,834 A * 10/2000 Southall ..... B03B 9/00 175/206
2016/0114334 A1* 4/2016 Patterson ..... B03B 5/34 241/38
2016/0228881 A1* 8/2016 Ivanoff ..... B03B 5/34

FOREIGN PATENT DOCUMENTS

DE 3043220 6/1982
DK 3006112 7/2017
FR 2636669 3/1990
GB 2523658 A * 9/2015 ..... B07B 1/005

(Continued)

OTHER PUBLICATIONS

European Search Report of corresponding EP Application No. EP18153531, dated Oct. 19, 2018.

*Primary Examiner* — Terrell H Matthews
(74) *Attorney, Agent, or Firm* — Gardner, Linn, Burkhart & Ondersma LLP

(57) ABSTRACT

An apparatus for washing and grading aggregate includes a chassis; a first grading screen mounted on the chassis for removing oversize material from a feed material; a first hydrocyclone mounted on the chassis receiving undersize material and water from the first grading screen; a second grading screen mounted on the chassis for producing at least one sand product, the second grading screen receiving an underflow from the first hydrocyclone; a second hydrocyclone mounted on the chassis receiving undersize material and water from the second grading screen; and an underflow from the second hydrocyclone being delivered onto the second grading screen.

15 Claims, 4 Drawing Sheets

(56) References Cited

FOREIGN PATENT DOCUMENTS

| | | |
|---|---|---|
| GB | 2528257 | 1/2016 |
| JP | H08103800 | 4/1996 |
| WO | 2009/090294 | 7/2009 |

* cited by examiner

METHOD AND APPARATUS FOR WASHING AND GRADING AGGREGATE

FIELD OF THE INVENTION

The present invention relates to a method and apparatus for washing and grading aggregate and in particular to a method and apparatus for washing and grading aggregate in a particularly compact and efficient manner for producing up to three grades of product (typically one of gravel and two of sand).

BACKGROUND OF THE INVENTION

Aggregate is a broad category of coarse particulate material used in construction, including sand, gravel and crushed stone. Aggregates are the most mined materials in the world. The term "sand" typically covers aggregate having a grain sand of between 0.075 mm and 4.75 mm while the term "gravel" typically covers aggregate having a grain size of between 4.75 mm and 76.2 mm. Aggregates are typically washed and graded on a combination of vibrating screens and hydrocyclones to produce washed aggregate products having a predetermined grain size or range of grain size.

A typical vibrating screen comprises a frame, defined by a pair of substantially parallel side walls interconnected by transversely extending bridging members, upon which is mounted a polyurethane deck having small openings or slots for water and undersize particles to pass through. The frame is typically mounted on a base via resilient linkages, and the frame (and thus the deck) is typically vibrated by means of a pair of counter rotating rotors defining eccentric masses, driven by one or more drive motors, to impart circular or reciprocating vibrating motion to the deck. Such screens can be used for grading and/or dewatering aggregate, oversize material passing over the deck of the screen to be collected from a downstream end of the screen while water and undersize material is collected in a sump of the screen for subsequent processing.

A hydrocyclone is a device used to separate particles in a liquid suspension based on the ratio of their centripetal force to fluid resistance. This ratio is high for coarse particles and low for fine particles. A hydrocyclone typically comprises a cylindrical section having an inlet for supplying a feed slurry into the hydrocyclone tangentially, and a conical base. Outlets are provided at upper and lower ends of the hydrocyclone. Underflow, containing the coarser fraction, passes out of the lower outlet while overflow, containing the finer fraction and most of the water, passes out of the outlet at the upper end of the hydrocyclone.

Most aggregate washing and grading plants are very large, including different stages comprising multiple grading and dewatering screens and hydrocyclones, and typically require a large volume of water to fluidise the material in each stage of the process and to transfer the material between different stages of the process. Such plants require considerable installation time and are not readily moveable once installed on a site.

SUMMARY OF THE INVENTION

The present invention provides a particularly compact, portable and adaptable apparatus and method of operation thereof, which can produce up to three different grades of washed aggregate product and which is readily moveable between sites.

According to a first aspect of the present invention there is provided an apparatus for washing and grading aggregate comprising a chassis, a first grading screen mounted on the chassis for removing oversize material from a feed material, a first hydrocyclone mounted on the chassis receiving undersize material and water from the first grading screen, a second grading screen mounted on the chassis for producing at least one sand product, the second grading screen receiving an underflow from the first hydrocyclone; a second hydrocyclone mounted on the chassis receiving undersize material and water from the second grading screen, an underflow from the second hydrocyclone being delivered onto the second grading screen.

In one embodiment the first grading screen may be mounted on a first end of the chassis, the second grading screen being mounted on a second end of the chassis, opposite the first end.

Optionally, a first conveyor extends laterally from the first end of the chassis, the first conveyor being configured to receive oversize material from the first grading screen.

Optionally, a second conveyor extends laterally from the second end of the chassis from a first side thereof, and a third conveyor extends laterally from the second end of the chassis from a second side thereof, opposite the first side, the second and third conveyors being configured to receive oversize material from the second grading screen.

The second grading screen may be configurable as a split screen having a longitudinally extending dividing wall separating the grading screen into first and second screening regions, each region being adapted to produce a separate sand product.

The underflow from the first hydrocyclone may be configured to be delivered onto the first screening region of the second grading screen and at least a portion of the underflow from the second hydrocyclone may be configured to be delivered onto the second screening region of the second grading screen.

The underflow from the second hydrocyclone may be received in a feed box, wherein the feed box is adapted to control the flow of the underflow onto the second grading screen.

The feed box may be adapted to deliver at least a portion of the underflow from the second hydrocyclone onto the second screening region of the second grading screen when configured as a split screen and a remainder of the underflow from the second hydrocyclone onto the first screening region of the second grading screen.

The second conveyor may be adapted to receive at least a portion of the oversize material from the first screening region of the second grading screen and the third conveyor is adapted to receive at least a portion of the oversize material from the second screening region of the second grading screen. A feed end of each of the second and third conveyors may be located beneath the discharge end of the second grading screen for receiving material therefrom, the second and third conveyors comprising a common conveyor assembly mounted on the chassis to be displaceable with respect to the chassis along an axis extending transverse to a longitudinal axis of the chassis such that the proportion of material falling from each of the first and second screening regions of the second grading screen onto each of the second and third conveyors can be varied.

Each of the first and second grading screens may comprise a frame mounted upon the chassis via resilient mounting means and upon which is mounted a screening surface having a plurality of apertures therein for grading and dewatering aggregate, the frame being provided with vibration generating means for imparting vibration to the frame, and sump beneath the screening surface for receiving water and undersize material therefrom. The sump of the first grading screen may be associated with a pump configured to pump water and undersize material therefrom to an inlet of the first hydrocyclone, the sump of the second grading screen being associated with a pump configured to pump water and undersize material therefrom to an inlet of the second hydrocyclone.

At least a portion of the overflow from one or both of the first and second hydrocyclones may be configured to be passed to the sump of one or both of the first and second grading screens to control the water content in the sump or sumps. A flow control means may be provided for controlling the passage of the overflow from one or both of the first and second hydrocyclones into the sump of one of both of the first and second grading screens.

According to a further aspect of the present invention there is provided a method of washing and grading aggregate material comprising passing a feed material onto a first grading screen, passing the overflow from the first grading screen onto a conveyor as a first aggregate product, pumping water and undersize material from a sump of the first grading screen into an first hydrocyclone, passing the underflow from the first hydrocyclone onto a second grading screen, passing the overflow from the second grading screen onto one or more conveyors as one or more sand products, pumping water and undersize material from a sump of the second grading screen into a second hydrocyclone and passing the underflow from the second hydrocyclone onto the second grading screen.

The second grading screen may comprise or may be selectively configurable to comprise a split deck screen producing two sand products.

These and other objects, advantages and features of the invention will become apparent upon review of the following specification in conjunction with the drawings.

BRIEF DESCRIPTION OF THE DRAWINGS

An apparatus for washing and grading aggregate in accordance with an embodiment of the present invention will now be described, with reference to the accompanying drawings, in which:—

DETAILED DESCRIPTION OF THE DRAWINGS

Figure 1:
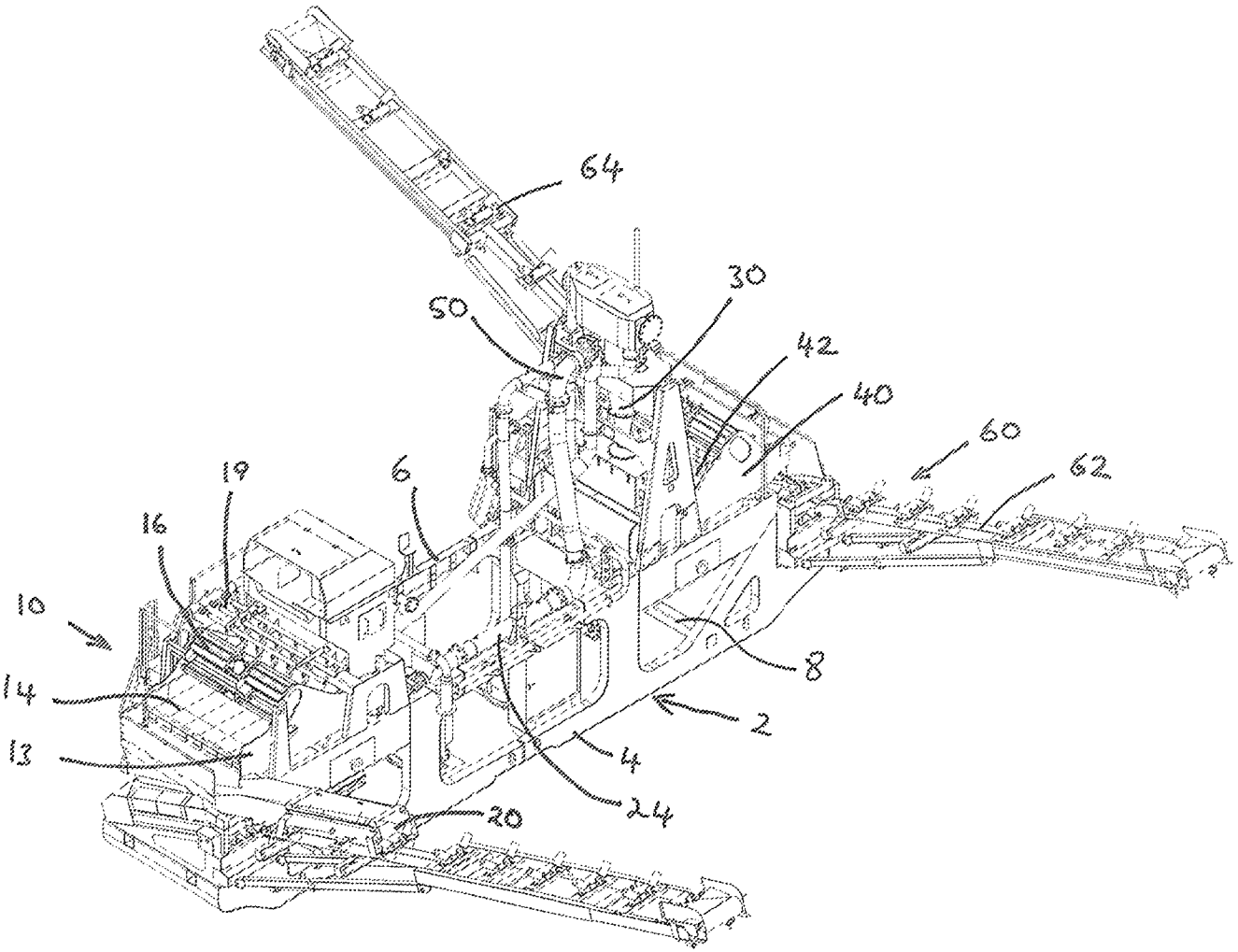
FIG. 1 is a perspective view of an apparatus for washing and grading aggregate in accordance with an embodiment of the present invention.
Figure 2:
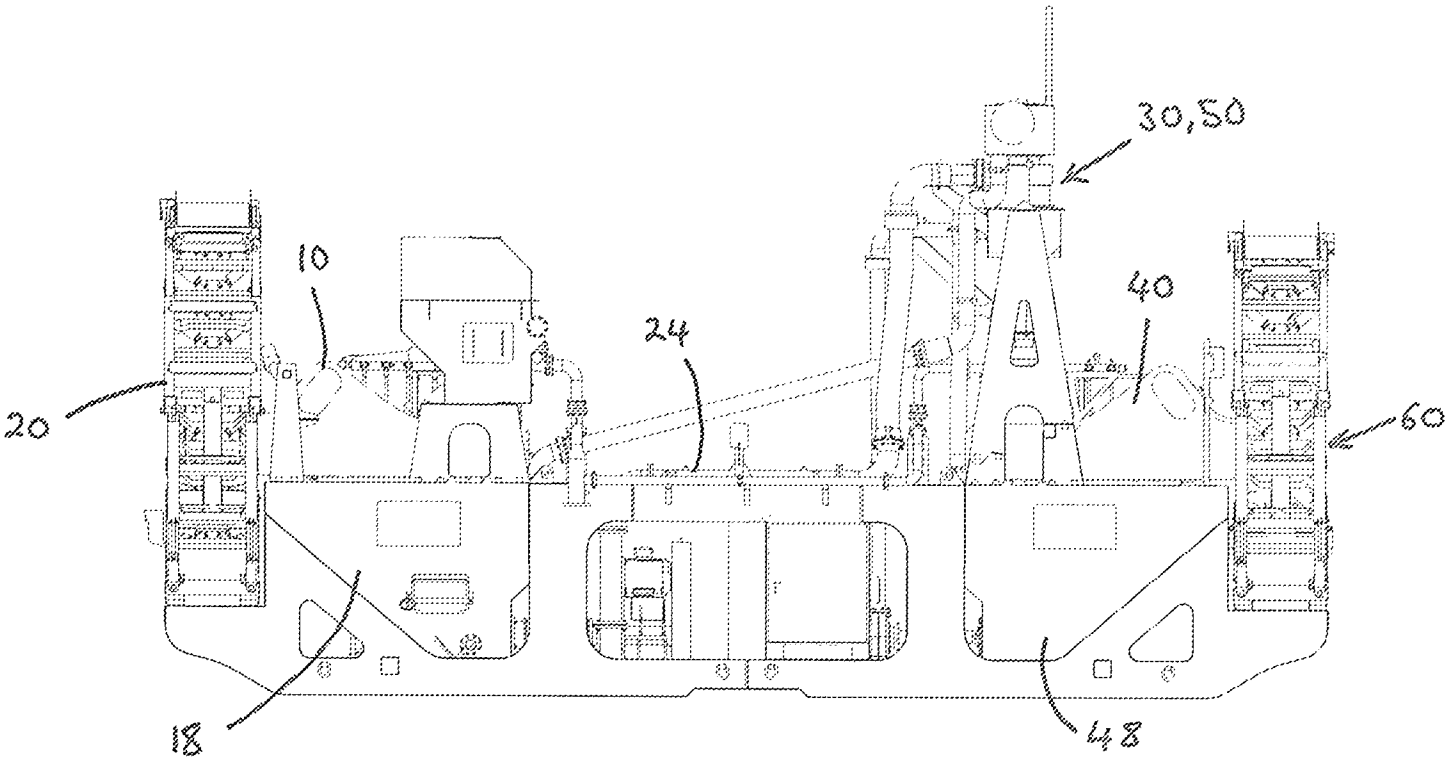
FIG. 2 is a side view of the apparatus of FIG. 1.

An apparatus for washing and grading aggregate in accordance with an embodiment of the present invention is illustrated in the drawings.

As illustrated in FIG. 1, the apparatus comprises an elongate once piece chassis 2 comprising spaced apart elongate chassis members 4, 6 linked by transverse bridging members 8. Optionally, the chassis 2 is dimensioned to fit into a standard shipping container and/or onto a trailer for transportation.

A first vibratory screen 10 is mounted at a first end of the chassis 2 for receiving a feed material thereon, the first screen 10 being mounted on the chassis 2 via resilient mounts and being formed from a pair of side plates 12,13 having bridging members (hidden in the drawings) extending therebetween. A deck 14 comprising polyurethane mats having a plurality of slots or apertures formed therein is mounted between the side plates 12,13. The feed material may be transferred onto the first screen 10 via a feed hopper and associated feed conveyor (not shown), as is conventional in the art.

A vibration generating means 16 is mounted between the side plates 12,13, extending transverse to the deck 14. The vibration generating means may comprise a pair of motor driven eccentrically loaded rotors mounted in a support tube mounted between the side plates 12,13 for rotation about substantially parallel rotational axes extending transverse to the deck 14.

Rotation of the rotor or rotors causes a rotating out of balance force to be applied to the screen 10, imparting a vibratory motion to the deck 14 and to the material carried thereon. Such vibratory motion causes material carried on the deck 14 to be agitated and fluidised, preventing blocking of the openings in the deck and causing oversize material on the deck 14 to be conveyed towards one end thereof while water and undersize material may pass through the deck 14 to be collected in a sump 18 beneath the deck 14 of the screen 10.

Each side wall 12,13 of the screen 10 may be made up of a laminated assembly of steel plates, such as disclosed in GB 2,505,483, which is hereby incorporated herein by reference in its entirety.

Spray bars 19 are mounted above the deck 14 for adding water to the material thereon.

The deck 14 of the first screen 10 has relatively large apertures formed therein, wherein sand, fine contaminants and water can pass through the apertures in the deck 14 while gravel and any large contaminants pass over the deck 14 to be delivered onto a first conveyor 20 extending laterally from the chassis 2 to be delivered onto a stock pile as a first aggregate product or for later disposal. The first screen 10 may be adapted to remove +6 mm material from the feed material.

A pump (22 FIGS. 3 and 4) is associated with the sump 18 beneath the deck 14 of the first screen 10 for pumping water and undersize material through a delivery pipe 24 to the inlet of a first hydrocyclone 30 mounted at a second end of the chassis 2, opposite the first end and above second vibratory screen 40. The first hydrocyclone 30 washes and dewaters the sand, removing find contaminants, such as silt and clay. Washed sand and some water passes out of the underflow of the first hydrocyclone 30 while water and fine contaminants pass out of the overflow thereof.

The second screen 40 is similar in construction to the first screen 10, having a deck 42 comprising slotted or apertured mats mounted between a pair of side plates, the second screen 40 being resiliently mounted on the chassis 2 and having a vibration generating means for imparting vibratory motion to the deck to agitate the material thereon. The deck 42 of the second screen 40 has smaller apertures than those of the first screen 10.

Optionally, the second screen 40 is adapted to be selectively configured as a split deck screen, wherein the screening deck 40 is divided into first and second screening regions 44,46, separated by a vertical longitudinally extending dividing wall 45. The apertures formed in the mats of the second screening region 46 are smaller than the apertures formed in the mats of the first screening region 44 such that two different grades (in terms of particle size) of sand are produced at a discharge end of the second screen 40 on either side of the dividing wall 45. The second screen 40 may be configured in such split screen configuration where it is desired to produce two grades of sand therefrom. Alternatively, where only a single grade of sand is required, the second screen 40 may be configured without such longitudinal dividing wall 45 and mats having a single aperture size may be used across the deck 42 of the second screen 40.

The first hydrocyclone 30 is mounted above the second screen 40 such that the underflow from the first hydrocyclone 30 is delivered onto the deck of the second screen 40. Undersize material and water passes through the deck 42 of the second screen 40 and is collected in a sump 48 beneath the deck 42. Optionally, the underflow from the first hydrocyclone 30 is adapted to be delivered onto one side region of the screen 40, corresponding to the first screening region 44 when the second screen 40 is in the split screen configuration.

A pump 49 is associated with the sump 48 of the second screen 40 for pumping the slurry of water and aggregate therefrom into the inlet of a second hydrocyclone 50. The second hydrocyclone 50 may be mounted above the second screen 40, alongside the first hydrocyclone 30.

The underflow from the second hydrocyclone 50 is passed into a feed box 52 and subsequently delivered on the deck 42 of the second screen 40, such as at least a portion being delivered onto the second screening region 46 of the second screen 40 when it is configured in its split screen configuration.

The provision of the second hydrocyclone 50 in addition to the first hydrocyclone 30 provides a dual pass fines washing system, maximising the removal of unwanted fines, such as silt, from the sand product or products produced by the second screen 40.

A conveyor assembly 60 is mounted beneath a discharge end of the deck 42 of the second screen 40 for receiving oversize material thereon. The conveyor assembly 60 may be of the type disclosed in GB 2 528 257, wherein the conveyor assembly 60 is mounted on the support chassis 2 to be displaceable laterally with respect to the second screen 40. The conveyor assembly 60 comprises first and second outwardly diverging belt conveyors 62,64 extending transversely from the chassis 2 in opposite directions, for delivering two sand products to separate stockpiles or a single sand product to one or both sides of the chassis 2. A collection hopper 66 is mounted above the feed ends of the first and second conveyors 62,64 for feeding oversize material from the second screen 40 onto the conveyors 62,64. A vertical dividing wall (not shown in the drawings) may be provided within the collection hopper 66 to divide the collection hopper 66 into a first region arranged to feed material onto the feed end of the first conveyor 62 and a second region arranged to feed material onto the feed end of the second conveyor 64.

By displacing the conveyor assembly 60 transversely with respect to chassis 2 and second screen 40, when the second screen 40 is in the split screen configuration, the proportion of material from each of first and second screening regions 44,46 (lateral sides) of the second screen 40 that is transferred onto each of the first and second conveyors 62,64 via the collection hopper 66 can be varied to adjust the rate of delivery of material from the conveyors 62,64 and/or the blend of material supplied from each conveyor 62,64.

At least a portion of the overflow from both the first and second hydrocyclones 30,50 may be passed into the sumps 18,48 of the first and second screens 10,40 as required to maintain a sufficient water content in the material in the sumps 18,48 to allow efficient operation of the pumps 22,49. A remaining portion of the overflow from the hydrocyclones 30,50 may be passed to a thickener tank or settling pond, wherein the silt and other fine contaminants may be removed to allow the water to be reused or suitably disposed of.

Figure 3:
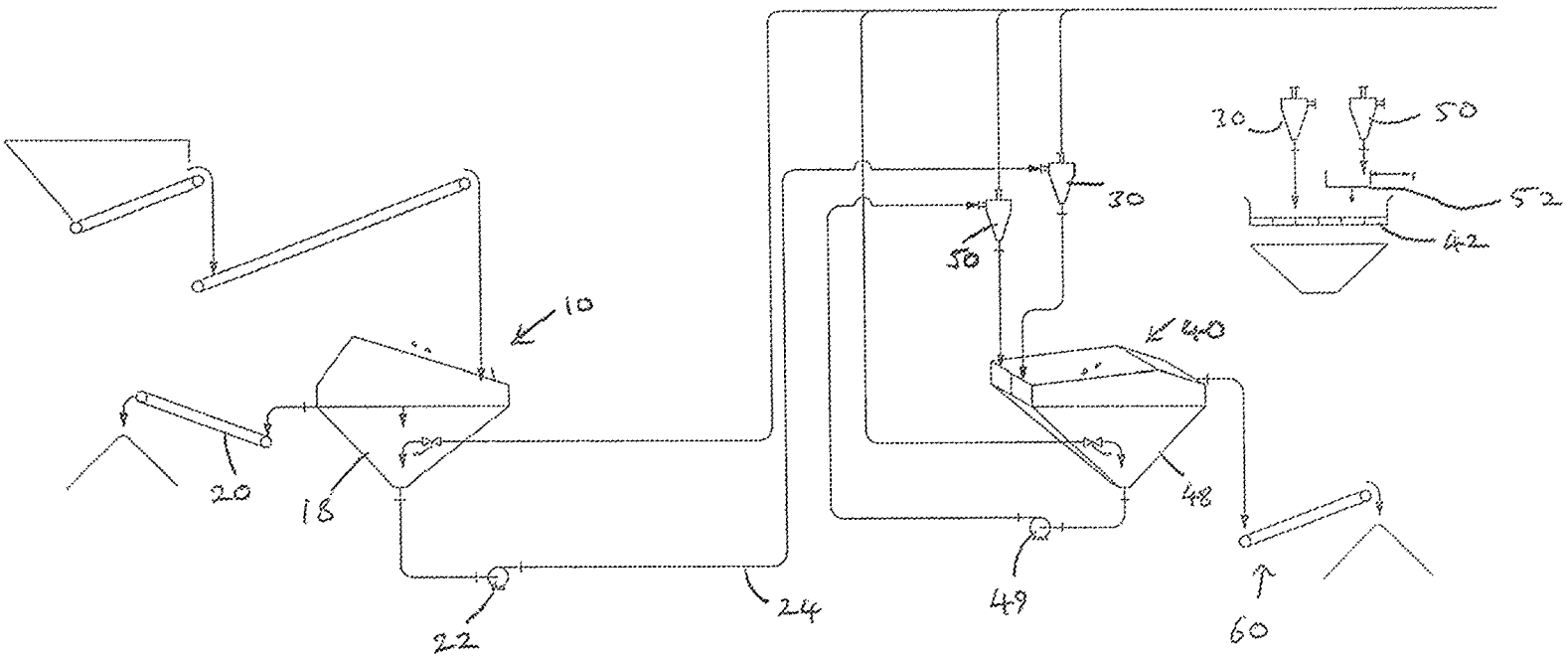
FIG. 3 is a schematic view of the operation of the apparatus of FIG. 1 in a first configuration.

FIG. 3 illustrates the use of the apparatus to produce one gravel product and one sand product. In such configuration, the second screen 40 is configured without the longitudinally extending wall 45 and with the deck 42 of the screen 40 defined by mats having slots or apertures of uniform size, such that one sand product is delivered from the downstream end of the deck 42 of the second screen 40.

Figure 4:
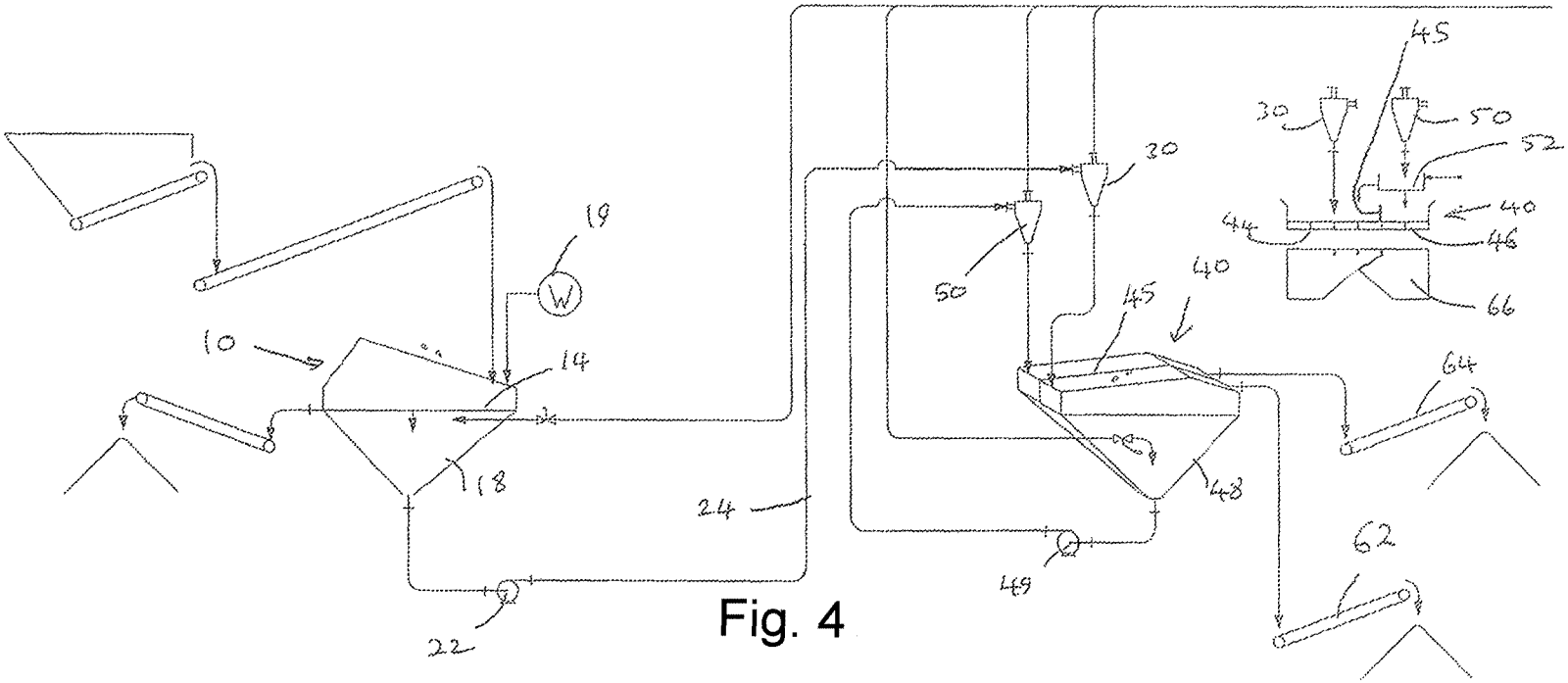
FIG. 4 is a schematic view of the operation of the apparatus of FIG. 1 in a second configuration.

FIG. 4 illustrates the use of the apparatus to produce one gravel product and two sand products. In such configuration, the longitudinally extending dividing wall 45 is fitted to the second screen 40 and the mats forming the deck 42 of the second screen on either side of the dividing wall 45 are configured to define the first and second screening regions 44,46 having different size apertures formed therein such that two different grades of sand are produced on the deck 42 on either side of the dividing wall 45.

Because the screens 10,40, cyclones 30,50 and conveyors 20,62,64 are mounted on a common chassis 2, the control systems for the screens, cyclones, conveyors and associated pumps can be installed on the chassis and pre-wired and tested for rapid commissioning of the apparatus. Folding walkways may be mounted around the screens to allow access while folding down to a compact size for transportation.

The invention is not limited to the embodiment(s) described herein but can be amended or modified without departing from the scope of the present invention, which is intended to be limited only by the scope of the appended claims as interpreted according to the principles of patent law including the doctrine of equivalents.

The invention claimed is:

1. An apparatus for washing and grading aggregate comprising a chassis, a first grading screen mounted on the chassis for removing oversize material from a feed material, a first hydrocyclone mounted on the chassis receiving undersize material and water from the first grading screen, a second grading screen mounted on the chassis for producing at least one sand product, the second grading screen receiving an underflow from the first hydrocyclone; a second hydrocyclone mounted on the chassis receiving undersize material and water from the second grading screen, an underflow from the second hydrocyclone being delivered onto the second grading screen, wherein the second grading screen is configurable as a split screen having a longitudinally extending dividing wall separating the grading screen into the first and second screening regions, each region being adapted to produce a separate sand product.

2. The apparatus as claimed in claim 1, wherein the first grading screen is mounted on a first end of the chassis, and the second grading screen is mounted on a second end of the chassis, opposite the first end.

3. The apparatus as claimed in claim 2, wherein a first conveyor extends laterally from the first end of the chassis, the first conveyor being configured to receive oversize material from the first grading screen.

4. The apparatus as claimed in claim 3, wherein a second conveyor extends laterally from the second end of the chassis from a first side thereof and a third conveyor extends laterally from the second end of the chassis from a second side thereof, opposite the first side, the second and third conveyors being configured to receive oversize material from the second grading screen.

5. An apparatus for washing and grading aggregates comprising a chassis, a first grading screen mounted on the chassis for removing oversize material from a feed material, a first hydrocyclone mounted on the chassis receiving undersize material and water from the first grading screen, a second grading screen mounted on the chassis for producing at least one sand product, the second grading screen receiving an underflow from the first hydrocyclone; a second hydrocyclone mounted on the chassis receiving undersize material and water from the second grading screen, an underflow from the second hydrocyclone being delivered onto the second grading screen, wherein each of the first and second grading screens comprise a frame mounted upon the chassis via resilient mounts and upon which is mounted a screening surface having a plurality of apertures therein for grading and dewatering aggregate, the frame being provided with a vibration generator for imparting vibration to the frame, and a sump beneath the screening surface for receiving water and undersize material therefrom.

6. The apparatus as claimed in claim 1, wherein the underflow from the first hydrocyclone is configured to be delivered onto the first screening region of the second grading screen and at least a portion of the underflow from the second hydrocyclone is configured to be delivered onto the second screening region of the second grading screen.

7. The apparatus as claimed in claim 6, wherein the underflow from the second hydrocyclone is received in a feed box, wherein the feed box is adapted to control the flow of the underflow onto the second grading screen.

8. The apparatus as claimed in claim 7, wherein the feed box is adapted to deliver at least a portion of the underflow from the second hydrocyclone onto the second screening region of the second grading screen when configured as a split screen and a remainder of the underflow from the second hydrocyclone onto the first screening region of the second grading screen.

9. The apparatus as claimed in claim 4, wherein the second conveyor is adapted to receive at least a portion of the oversize material from the first screening region of the second grading screen and the third conveyor is adapted to receive at least a portion of the oversize material from the second screening region of the second grading screen.

10. The apparatus as claimed in claim 9, wherein a feed end of each of the second and third conveyors is located beneath the discharge end of the second grading screen for receiving material therefrom, the second and third conveyors comprising a common conveyor assembly mounted on the chassis to be displaceable with respect to the chassis along an axis extending transverse to a longitudinal axis of the chassis such that the proportion of material falling from each of the first and second screening regions of the second grading screen onto each of the second and third conveyors can be varied.

11. The apparatus as claimed in claim 5, wherein the second grading screen is configurable as a split screen having a longitudinally extending dividing wall separating the grading screen into first and second screening regions, each region being adapted to produce a separate sand product.

12. The apparatus as claimed in claim 5, wherein the sump of the first grading screen is associated with a pump configured to pump water and undersize material therefrom to an inlet of the first hydrocyclone, the sump of the second grading screen being associated with a pump configured to pump water and undersize material therefrom to an inlet of the second hydrocyclone.

13. The apparatus as claimed in claim 12, wherein at least a portion of the overflow from one or both of the first and second hydrocyclones is configured to be passed to the sump of one or both of the first and second grading screens to control the water content in the sump.

14. The apparatus as claimed in claim 13, wherein a flow control device is provided for controlling the passage of the overflow from one or both of the first and second hydrocyclones into the sump of one of both of the first and second grading screens.

15. A method of washing and grading aggregate material comprising passing a feed material onto a chassis-mounted first grading screen, passing the overflow from the first grading screen onto a conveyor as a first aggregate product, pumping water and undersize material from a sump of the first grading screen into an chassis-mounted first hydrocyclone, passing the underflow from the first hydrocyclone onto a second grading screen, passing the overflow from the chassis-mounted second grading screen onto one or more conveyors as one or more sand products, pumping water and undersize material from a sump of the second grading screen into a chassis-mounted second hydrocyclone, and passing the underflow from the second hydrocyclone onto the second grading screen, wherein the second grading screen comprises or is selectively configurable to comprise a split deck screen producing two sand products.

* * * * *